US005795619A

United States Patent [19]

Lin et al.

[11] Patent Number: 5,795,619

[45] Date of Patent: Aug. 18, 1998

[54] SOLDER BUMP FABRICATED METHOD INCORPORATE WITH ELECTROLESS DEPOSIT AND DIP SOLDER

[75] Inventors: Kwang-Lung Lin; Chwan-Ying Lee, both of Tainan, Taiwan

[73] Assignee: National Science Council, Taipei, Taiwan

[21] Appl. No.: 571,401

[22] Filed: Dec. 13, 1995

[51] Int. Cl.[6] ..... B05D 5/12

[52] U.S. Cl. ..... 427/123; 427/305; 427/328; 427/433; 427/438; 148/23; 228/180.1; 228/223; 228/224

[58] Field of Search ..... 427/98, 123, 125, 427/305, 328, 433, 438; 148/23–26; 228/180.1, 223, 224; 106/14.13–14.18

[56] References Cited

U.S. PATENT DOCUMENTS

| | | | |
|---|---|---|---|
| 3,953,624 | 4/1976 | Arnold | 427/305 |
| 3,982,055 | 9/1976 | Howard | 427/309 |
| 4,125,648 | 11/1978 | Vratny | 427/305 |
| 4,162,899 | 7/1979 | Molnar et al. | 51/295 |
| 4,666,667 | 5/1987 | Kamio et al. | 420/471 |
| 4,840,820 | 6/1989 | Schultz et al. | 427/305 |
| 4,988,395 | 1/1991 | Taguchi et al. | 148/24 |
| 5,028,454 | 7/1991 | Lytle et al. | 427/123 |

FOREIGN PATENT DOCUMENTS

| | | |
|---|---|---|
| 223628 | 9/1989 | Japan . |

*Primary Examiner*—Shrive Beck
*Assistant Examiner*—Brian K. Talbot
*Attorney, Agent, or Firm*—Beveridge, DeGrandi, Weilacher & Young LLP

[57] ABSTRACT

A process for preparing a solder bump can be prepared by the following procedure. The chip package was cleaned with an alkali or acid solution followed by Zn displacement (zincating)in a displacement solution which comprises NaOH, $Z_n$o, potassium sodium tartrate and sodium nitrate. After zinc displacement the chip package was performed the electroless Ni—Cu—P deposit in the strong reducing solution which contains $NaH_2PO_2$. The chip package deposited with Ni—Cu—P was then dipped into an organic solution as flux which is a mixture of the stearic acid and glutamic acid. Finally, dip soldering of the Ni—Cu—P deposited chip packages in a molten solder bath at a temperature 40°~80° C. higher than the melting point of the corresponding Pb—Sn alloy.

12 Claims, 9 Drawing Sheets

FIG. 2A
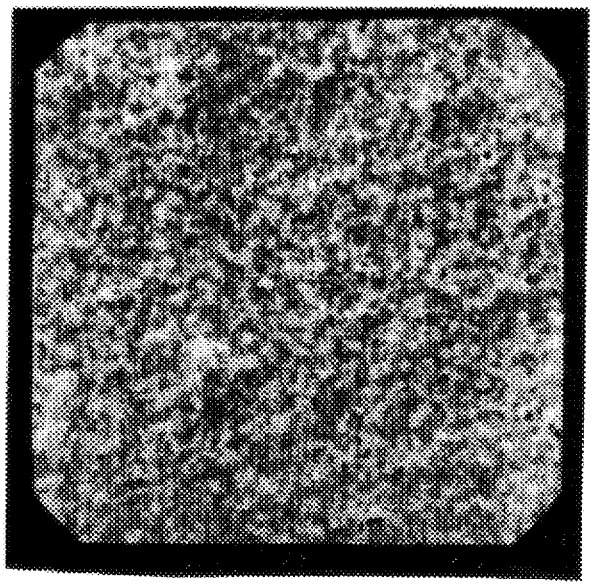
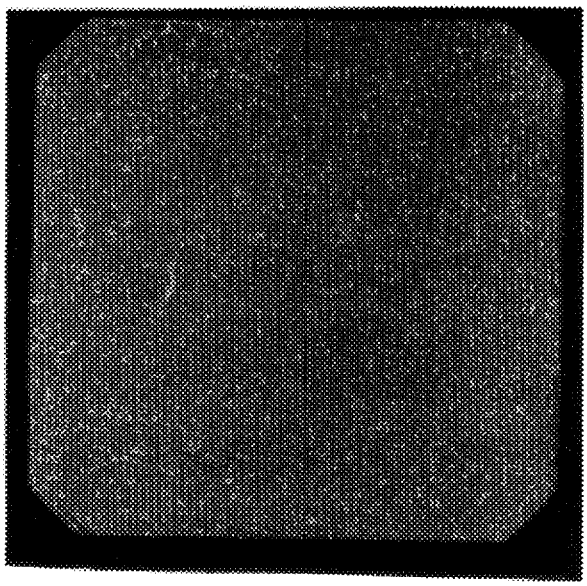
FIG. 2B

SOLDER BUMP FABRICATED METHOD INCORPORATE WITH ELECTROLESS DEPOSIT AND DIP SOLDER

BACKGROUND OF THE INVENTION

The main purpose of the electronic packaging technology is to provide the electronic product with good function, high reliability, and fast cooling to avoid the damage of circuit by overheating. M. R. Pinnel et al. (AT&T Technical Journal, 66(4), 45–56, 1987) has described the technique of electronic packaging. Generally, the electronic packaging can be divided into four levels:(1)Chip packaging, the Si-packed chip is a basic element; (2) Substrate circuit packaging, it is a combination package which is to combine the chip with multilayer film, line or tape; (3). Shelf level packaging; (4). Frame level packaging. Wherein, the associated technique level is coming up with the series of different package layers from substrate to whole system. In present, in order to upgrade the function of electronic product, many companies pay more attention to develop a new material or process which can replace the present techniques in the whole world wide.

Conventionally, the following modes are adopted by the chip packaging: DIP (dual in line package); SK-DIP(skinny DIP) and PGA(pin grid array). However, the occupied volume is too big and the density of input/output in chip is too less, therefore, this kind package is almost replaced by a surface mounting technology(SMT). But the SMT can not satisfy the demand of product with high function and high density, so the chip-on-board(COB) technology has been developed. The chip board bonding technology is to bond the chip to the surface of an organic or inorganic printed wiring board(PWB), to protect the chip with encapsulation. M. Hatamian et al., (AT&T Technical Journal, 66(4), 81–95, 1987) described the chip-board-bonding in the following ways: double sided epoxy glass board, four-layer multilayer board, six-layer multilayer board, multiwire board, wire wrap board, and quick connect board. In addition, industry implemented frequently the ways which consist of the tape automated bonding, flip chip bonding, and wire bonding. Wherein, the tape automated bonding owns many advantages, such as: testing each integrated circuit before assembling, producing by automatic process, and high reliability in configuration. But, the flip chip bonding can provide the advantages including higher speed of signal transmitt, less probability of signal delay, and obtained a highest bonding density. In the past, the chip-board bonding technology is applied in the field of single chip package only. Recently, IBM and AT&T have applied the flip chip bonding(FCB) technology to multichip module packages, IBM applied the FCB to multilayer ceramic board also.

The multichip module package is to gather many bare chips on a chip module. The out-shape of this kind module is the same as that of the conventional packaging methods like PGA and QFP which mount many chips on the board. The key advantage of multichip module is to reduce the occupied space of element obviously, to shorten the delay time of signal by the shorter line, to cut down the capacitance and inductance of all circuits in the whole system. Therefore, the stability of whole system is increased with MCM. If the existing bottleneck that combines the multilayer module and flip chip bonding can be solved, the density of system package would be promoted and system function would be increased also.

In order to conduct the circuit board contact after bonding, fabricating the solder bump on the surface of IC Al-pad is required with the known flip chip bonding technology. Generally, the adopted solder bump is the material of lead-tin alloy or some kind metal layer, the provided functions are different with the chosen materials. K. Nakamura et al.( Appl. Phys. Lett. 28, 277, 1976) and J. K. Howard et al.( J. Vac. Sci. Technol., 13, 68–71, 1976) depicted that transition-metal(Ti or Cr) films have been used as the adhesive layer and provide the bonding between Al and passivation. J. M. Oparowiski et. al.(Thin Solid Films, 153, 313–28,1987) proposed that the formation of a diffusion barrier layer can prevent the diffusion from occurring between Pb—Sn alloy and Al substrate. P. A. Totta(IBM J. Res. Develop. 5(5), 226–38, 1969) applied Ag and Au to form a thin film as an oxidation resistance/wetting layer, this layer provides appropriate wetting to solder and prevent the oxidation from occurring in the diffusion barrier.

The technology that using the Ti—W—Au alloy as the under bump metallurgy has been developed successfully in Material Research Laboratory in Taiwan, IBM, and G. E. Blonder et al. (AT&T Technical Journal, 70(11), 46, 1990) illustrated the technology that fabricated the bump with the Cr/Cu/Au metals. P. A. Totta(1976) proposed that the Cr can create a well adhesion between Cr and passivation. Cr metal to be used as an adhesive layer, and Cu metal can provide an appropriate wetting for the Pb—Sn alloy to be deposited. In addition to the above characteristics, a thin Au film possesses the function protecting the Cu surface from oxidation and an advantage of increasing the solderability. The formation of intermetallic compound in Cu/Sn mixture is very easy and the reaction of Cr/Sn does not occur during the subsequent solder reflow cycle. Accordingly, the solder bump can apply Cr/Cu/Au as the diffusion barrier. As the temperature of solder bump is cooled down to ambient after reflow, the adhesion between the solder bump and Al pad can keep in a good status.

The application of evaporation and sputtering in fabricating the solder bump is a traditional manner, hence, a vacuum environment is generally applied in fabricating operation. On the other hand, there have many disadvantages in this process, such as: the Si-chip needs a mask to prevent the metal from depositing on the surface of passivation layer in the evaporation process. When fabricating solder bump with evaporation, the deposition of Pb and Sn should be conducted sequentially due to the higher vapor pressure of lead. This sequential process leads to the phenomena of poor uniformity in composition distribution, flat out-shape, and false bonding to substrate. It is required that the solder deposited chip is heated to an appropriate temperature for reflowing the solder. This traditional manufacturing process is too complicate and time consuming. It is desirable to develop a simplified solder bump fabrication process.

BRIEF DESCRIPTION OF THE DRAWINGS

The present invention can be more fully understood by reference with the following detailed descriptions and the accompanying drawings, wherein:

FIG. 2: 2*a*,2*b* are scanning electron micrographs of the surface morphology and Zn elemental distribution on the surface of Zn-displaced Al pad.

DESCRIPTION OF THE INVENTION

Figure 1:
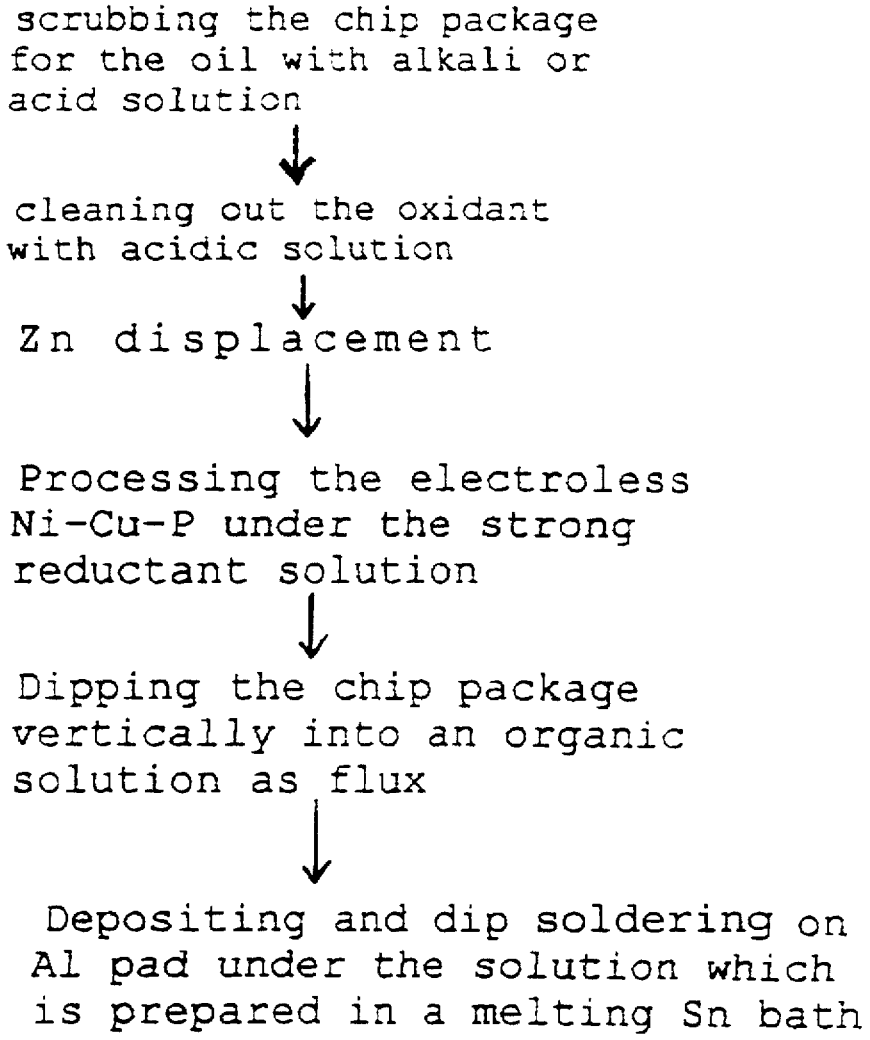
FIG. 1: The process flow diagram of this invented method which include different steps for fabricating the solder bump.
Figure 3A:
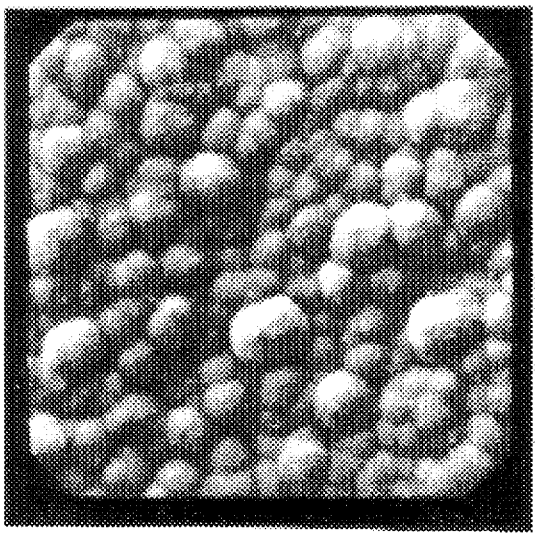
FIG. 3: 3*a*, is the scanning electron micrograph of the surface morphology of electroless Ni—Cu—P; 3*b* shows the mapping of Ni; 3*c* shows the mapping of Cu, and 3*d* shows the mapping of P elements.
Figure 3B:
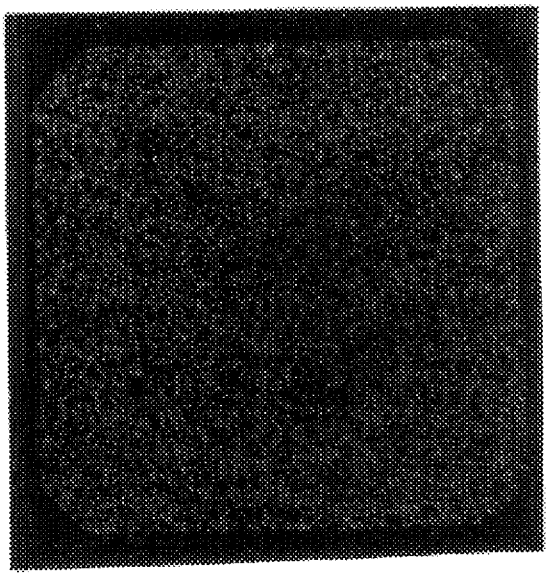
Figure 3C:
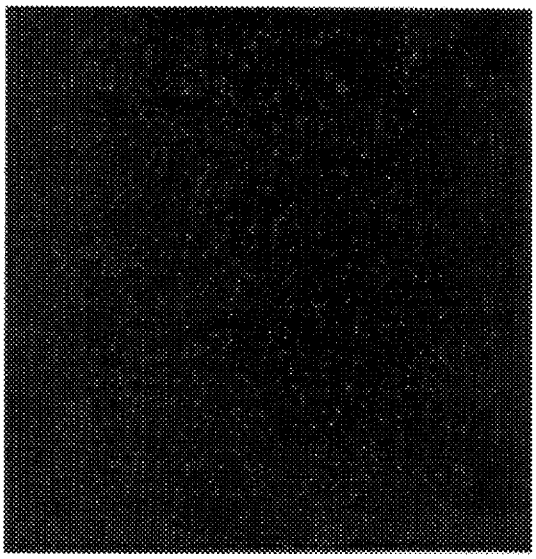
Figure 3D:
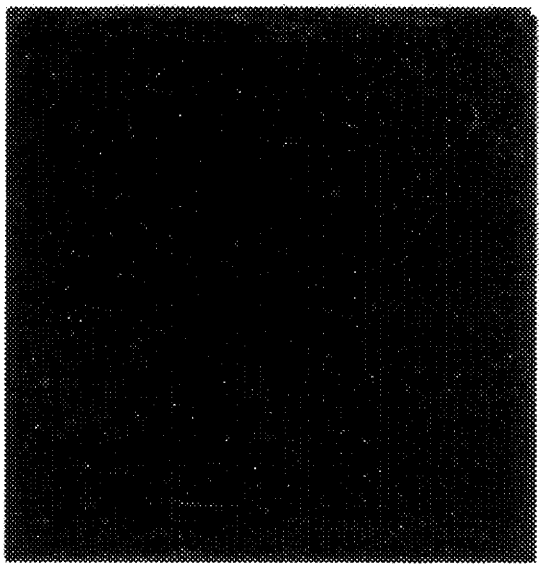

The method for fabricating the solder bump is closely confined with the alloys selected, the metal layer materials and the bump function. For example, it needs to not only consider the adhesion characteristics between the selected materials and the Al pad but also to evaluate the reaction rate and atomic diffusivities among the bump structure. S. P. Maurarka et al.(VLSI Technology ed. 2, McGraw-Hill, 1987) concluded that the grain boundary diffusion is more apparent than the volume diffusion as the metal film is laid in a low temperature state. Certainly, the materials which possess single crystal or amorphous characteristics can be chosen to solve the problem of grain boundary diffusion. Nevertheless, the fabrication of a single crystal on the bump is very difficult. H. G. Schenzel et al.(Plating and Surface Finishing, 77(10), 50–54, 1987), instead, applied the electroless Ni technique. The advantages of using the electroless Ni as the adhesion layer and diffusion barrier materials are followings: (1). it possesses the structure of amorphous; (2). the selective depositing capability that will not deposit on the surface of non-catalytic passivation film; (3). the good adhesion exists between the electroless Ni and Al metal; (4). the reaction rate is slow between electroless Ni and Pb—Sn alloy. K. Wong et al.(Plating and Surface Finishing, 75(7), 70–76, 1988) illucidated the combination of electroless Ni deposition and dip soldering of Pb—Sn to from the solder bump. However, wherein the composition of the electroless nickel is Ni—P binary alloy.

In the technology of electronic packaging, the first level packaging is to bond the chip to substrate, while the second level packaging is to bond the substrate to card. Generally, Pb—Sn alloy component which has the higher melting point was chosen for processing the first level packaging. The lower melting point solder was chosen in subsequent process for the higher level packaging to avoid melting of the previously bonded bump. Therefore, the composition used in first level package can be 95Pb—5Sn.

In electronic industry, the solder bump fabrication generally uses a flux, it is a rosin which consists three Hiterpene isomers: sylvic acid, d -pimaric acid and l -pimaric acid. At 300° C. the molecular structure of sylvic acid will rearrange to become a mixture which contains neo-abietic acid and pyro-abietic acid. These two acids are inert compounds, hence, the rosin species is not suitable as a flux for high melting point of Pb—Sn alloy. J. Simon et al.(Metal Finishing, 88 (10), 23–24, 1990) proposed the TAB technology which applied directly the electroless nickel as the bumps on the silicon chip. The Ni bumps, as with a high hardness needs to incorporate with a thick layer of tin(7–9 μm) selectively plated on the inner leads to compensate the nonplanarity of the thermode. The practical application of this process to flip chip bonding needs to do more advanced study.

In the above descriptions, the electroless Ni—P must not have an oxidation layer formed on the surface. Generally, an electroless Au layer can be deposited on the surface of the Ni—P. The incorporation of Au deposit will increase the cost as well as cause the dissolution of Au into the solder alloy resulting in poor adhesion. On the other hand, R. C. Aarwala et al.(Metallkd. 83(3), 199, 1992) depicted another disadvantage that the phase transformation will give rise to the $Ni_3P$ phase in the electroless Ni—P deposit under 300° C. The diffusion barrier function of the electroless Ni—P will degrade under this phase transformation.

Generally, the electroless deposition is defined as follows: utilizing the metal ions existing in the deposition solutions to form a thin metal film on a substrate with the aid of a reductant of the deposition solution. On the other hand the dipping deposition method is defined as: immersing the substrate into the molten bath under an appropriate temperature and speed to produce a suitable deposit on the substrate. With these two methods, there has one common factor that no external electrical current is required.

According to the process of the present invention, it is to reduce the Ni ion and Cu ion to metal Ni and metal Cu from a deposition solution which composed of the strong reducing reagent, sodium hypophosphite. The dipping deposition of Pb—Sn alloy is performed as by immersing the chip vertically into the molten solder bath under an appropriate temperature and speed. Thus conducted process, due to the wettability between solder and electroless Ni—Cu—P, deposits the bump on the electroless Ni—Cu—P deposit. The deposition of electroless Ni requires a catalytic substrate surface. The afterwards deposited surface possesses the self-catalytic capability to further reduce metal ion. Hence, it is not required to use the mask in the electroless process to deposit Ni or Cu on Al pad, which becomes the characteristics of this selective deposition mode. The merit of uniform thickness and superior anti-corrosion can be obtained in the electroless process, there has no problems of grain boundary diffusion with the amorphous deposits. The fabricated bump provides low diffusivity within the two adjacent metal layers and good solderability.

According to the process of the present invention, the process flow diagram is shown as FIG. 1, it consists of a suitable cleaning of the chip package with an alkali or an acid solution, Zn displacement for a suitable time period under the displacement solution. The chip package is then performed the electroless Ni—Cu—P deposition under the strong reducing solution which contains $NaH_2PO_2$, followed by dipping the chip package into an organic flux solution and then dipping soldered in a molten solder bath. Wherein, the alkali solution is sodium hydroxide NaOH, the acidic solution is $HNO_3$, HCl generally. In the traditional Zn-displacement solution contains the high concentrated NaOH so that the Al pad is dissolved easily due to the longer displacement time and Zn element can be distributed uniformly on the Al pad as the shorter displacement time. In this invention, the appropriate deposition time of Zn-displacement is achieved by adding the cyanide and tartaric acid to the displacement solution so that it contains NaOH, ZnO, cyanide, tartaric acid and sodium nitrate, etc. This displacement solution allows the uniform deposition of Zn deposit on Al pad and the reaction time is controlled to be less than one minute to avoid the Al pad be fully dissolved, and resulting in the good leveling of the electroless Ni—Cu—P deposit. The principal components of the electroless Ni—Cu—P deposition solutions are the sulfates of Ni and Cu metals, sodium phosphate, amide etc. In this invention, the flux chosen is a long chain fatty acid, in general, stearic acid, glutamic acid . . . etc. in which the carbon number is higher than ten. The flux is mixed with an alkanol, which is an alcohol with the carbon number of less than ten, such as methanol, ethanol, propanol . . . etc., but the better one is a stearic acid, glutamic acid solution. A molten solder bath applied is at a temperature being 40°–80° C. higher than the melting point of the corresponding Pb—Sn alloy. The dip soldering was performed at a speed of 12 to 19 mm/sec into the melting solder bath. The pH value is 8.5–9.5 in the solution of electroless Ni—Cu—P deposition.

According to the process of the present invention, the electroless Ni—Cu—P is used as the material of metal layer under the bonding point. This deposit not only possesses the above mentioned advantage of electroless Ni—P deposit but also exhibits a superior solderability. It needs not to incorporate an electroless Au deposit on its surface for avoiding the oxidation. Meanwhile, the recrystallization temperature of the Ni—Cu—P deposit is about 400° C., and thus allowed to be applied in a process with high Pb contents solder.

Figure 4:
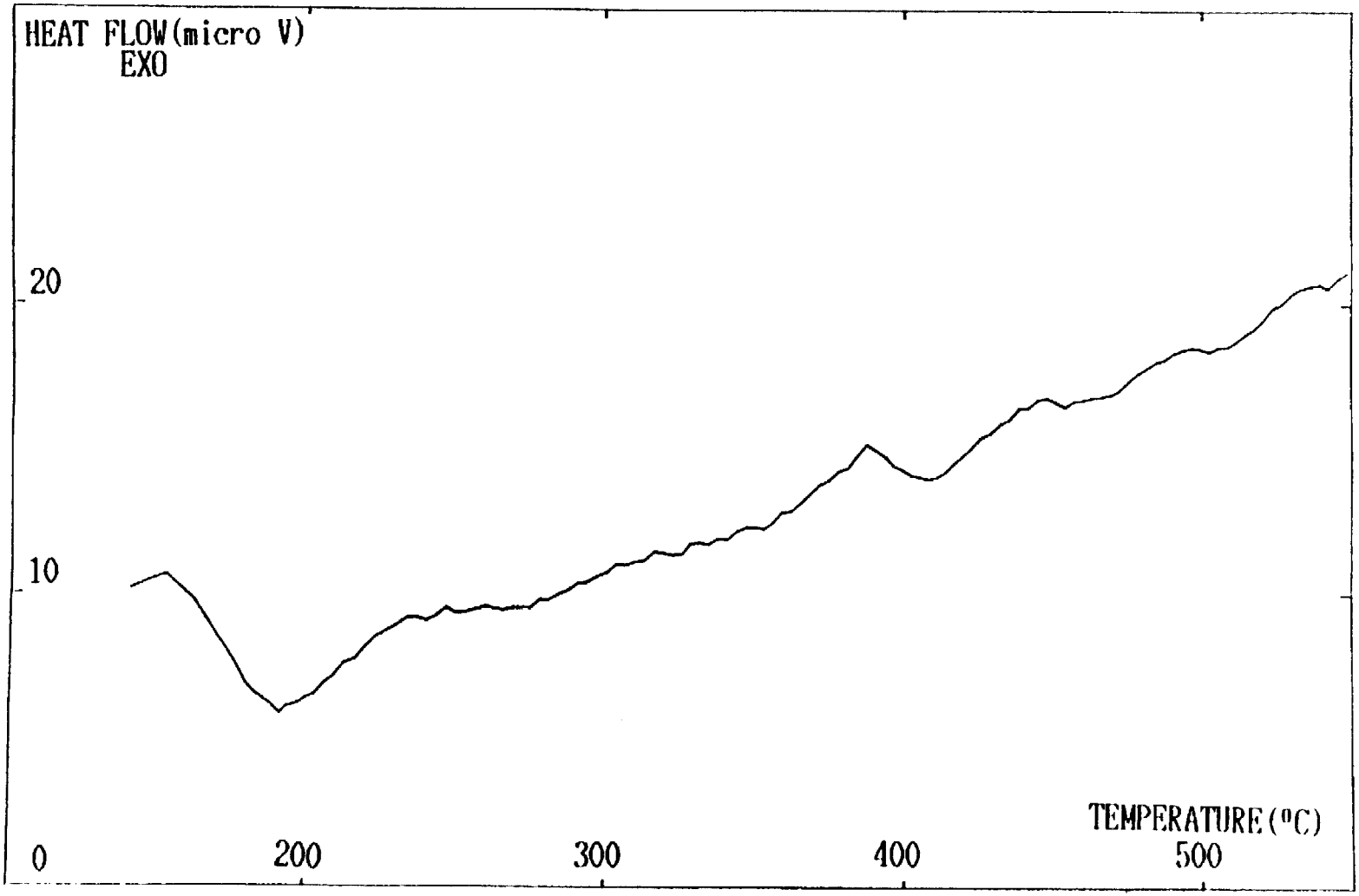
FIG. 4: The DTA curve of the electroless Ni—Cu—P deposit.
Figure 5:
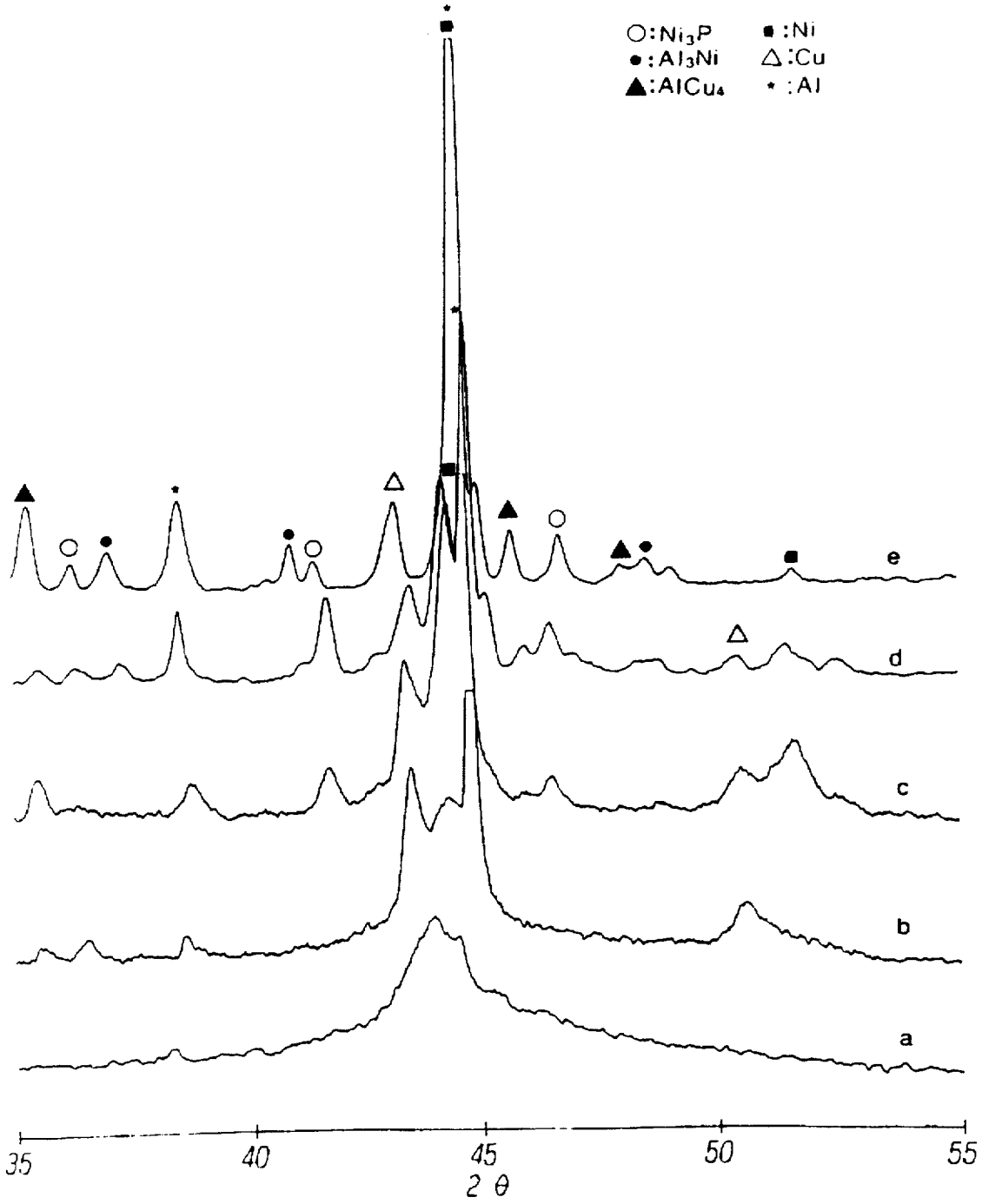
FIG. 5 is an X-ray diffraction pattern of the electroless Ni—Cu—P deposits: (a). as-deposited; (b)–(e)thermally treated for 1 hour under the different conditions, (b) 300 ° C. (c)400° C. (d).500° C. (e).600° C. the curve legends are: ○ $Ni_3P$• $Al_3Ni$ ▲ $AlCu_4$ ■ Ni Δ Cu * Al

The differential thermal analysis of electroless Ni—Cu—P is shown as in FIG. 4, there has a wide endothermic peak at 190° C. and an exothermic peak appears at 390° C. The crystallization process of electroless Ni—Cu—P alloy can be understood from DTA and FIG.5 which is the XRD of electroless Ni—Cu—P deposits with thermal treatment under various temperatures. As shown in FIG. 5, the element of P and Cu in the electroless Ni—Cu—P deposit exhibit in the super saturated solid solution and the XRD of the as deposited Ni—Cu—P deposit exhibits the diffraction peak of Ni only. This phenomenon is the same as described in the literatures. The deposit layer produces Ni and $Ni_3P$ phases with thermal treatment under 400° C. for an hour, corresponding to the DTA exothermic at 390° C. However, there has no any diffraction peak of the compounds which contain Cu and P, such as $Cu_3P$, even if the electroless Ni—Cu—P deposit was treated under 600° C. for an hour.

Figure 6:
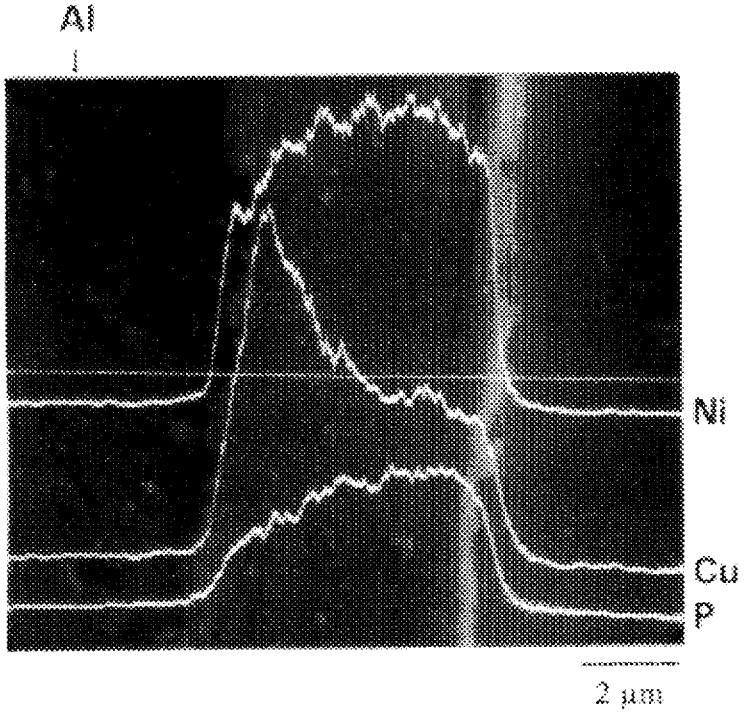
FIG. 6 is an elemental scans of the electroless Ni—Cu—P deposit after thermal treatment at 200° C. for an hour.
Figure 7:
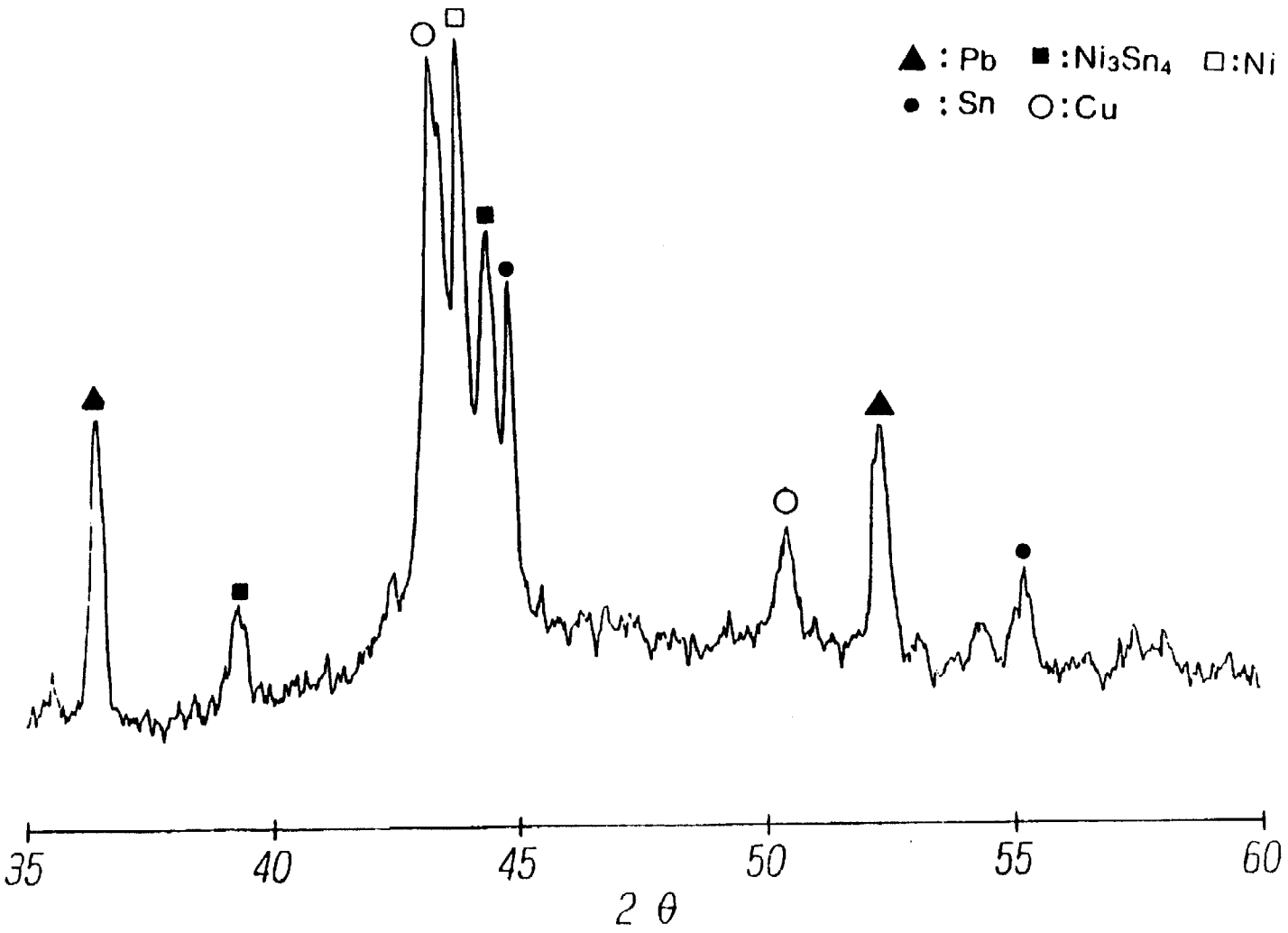
FIG. 7 is a morphology of the intermetallic compounds formed at the interface between the electroless Ni—Cu—P layer and solder bump(SEM image) after heat treatment at 250° C. for 16 hours.
Figure 8:
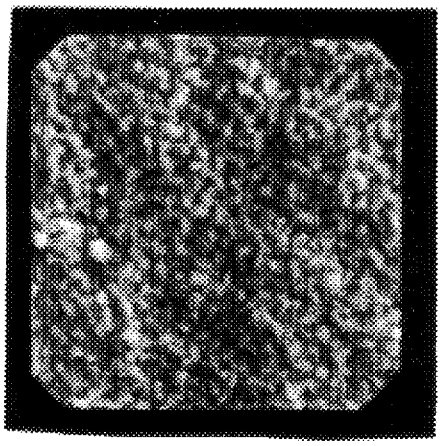
FIG. 8 is an X-ray diffraction pattern of the existing metal compounds at the interface between the electroless Ni—Cu—P layer and solder bump(corresponding to FIG. 7).
Figure 9:
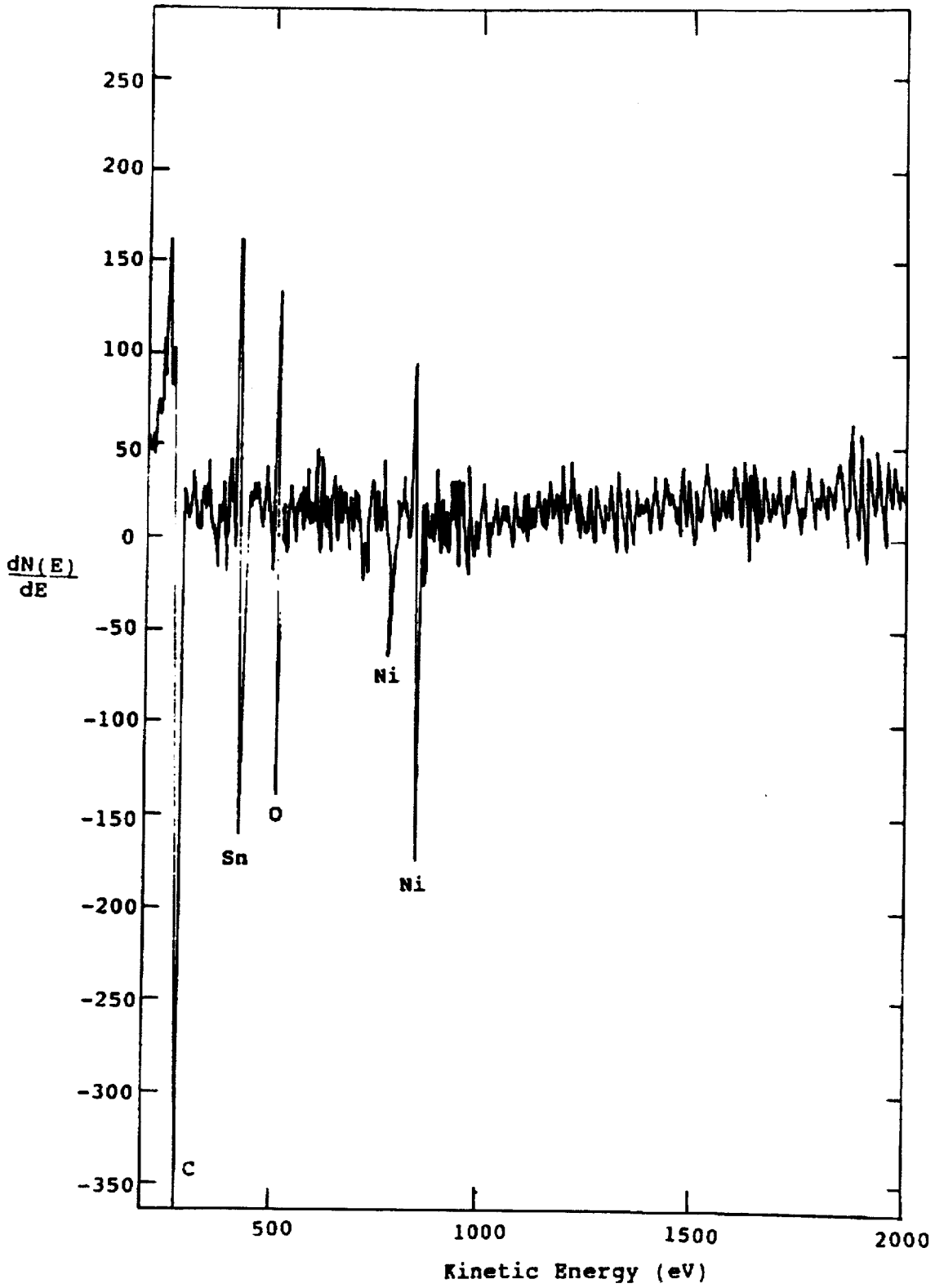
FIG. 9 is an AES analysis diagram of the surface state characteristics at the interface between the electroless Ni—Cu—P layer and solder bump(corresponding to FIG. 7).

The fabricated solder bump was heated at 250° C. for 16 hours to investigate the diffusion behaviors. The diffusion behaviors of the elements was shown in FIG. 6 in terms of SEM elemental line scanning. It shows that the Cu element gathered in the bottom layer closing to Al even though the Cu and Pb—Sn alloy reacted easily to from a compound. Nevertheless, the thermodynamically favorable reaction between Cu and solder did not occur due to the Ni barrier. The Pb—Sn alloy is immersed in a corrosion solution to etch off the solder and to lay the intermetallic compounds bare. The XRD of the thus revealed intermetallic compounds existing at the interface between the electroless Ni—Cu—P deposit and solder as shown in FIG. 7, shows that the compound layer has the $Ni_3Sn_4$ phase only, while the diffraction peaks of the $Cu_3Sn_3$ or $Cu_6Sn_5$ does not appear. The surface morphology of the intermetallic compounds existing at the interface is shown in FIG. 8. The AES analysis curve of the interface, FIG. 9 shows that the compound layer contains Ni but no Cu. All the experimental results show that the electroless Ni—Cu—P deposit layer is effective in inhibiting the reaction between Al and solder.

This invention has demonstrated an appropriate solder bump with a combination of Al/Ni—Cu—P/Pb—Sn formed by electroless Ni—Cu—P deposition in a strong reducing solution and dip soldering in a molten solder bath.

In order to evaluate the solder bump which owns a good mechanic performance after a long time use, the solder bump is tested for its adhesive after heating at 150° C. for 1,000 hours. The final result in this invention shows that the solder bump fabricated by the electroless Ni—Cu—P deposition and the dip soldering methods has 2095.5 psi adhesive force, while the fabricated solder bump by the electroless Ni—P exhibits an adhesive force of only 1100 psi under the same testing condition as that for Ni—Cu—P bumps. This result shows that the solder bumps incorporated with electroless Ni—Cu—P deposit applying the proposed method in this invention owns the excellent adhesion.

In order to explain more obviously the purpose, method and special advantages in this invention, two typical examples are implemented for the illustrations of the process in the present invention more specifically. But the extents of present invention are not limited by the described examples.

Example 1

The aluminum pad on the chip package was degreased in an alkaline solution of NaOH(5% by mass) for 30 sec., followed by deoxidized in a nitric acid(40 VOL%) solution. Then the substrate was immersed in a zincate solution which is composed of 120 g/L NaOH, 20 g/L ZnO, 1 g/L $NaNO_3$ and 50 g/L $C_4H_4KNOhd$ 6 $\cdot 4H_2O$ for 30 sec. before electroless plating, followed by electroless Ni—Cu—P deposition. Deposition was conducted at pH 9, adjusted with ammonia. The electroless Ni—Cu—P solution consisted of 40 g/L $NH_4Cl$, 15 g/L $NaH_2PO_2 \cdot H_2O$, 30 g/L $NiSO_4 \cdot 7H_2O$, 1.5 g/L $CuSO_4 \cdot 5H_2O$, 50 g/L $Na_3C_6H_5O_7 \cdot 2H_2O$ (sodium citrate). The thickness of the electroless Ni—Cu—P deposits was controlled to about 21 μm. The final result shows that the Ni—Cu—P deposit consisted of 74 wt% Cu and 3 wt%P.

Example 2

Following the similar process described in example 1, to finish the cleaning of the chip package with 10% KOH solution and then with a 60% nitric acid solution. The substrate was immersed into a zincate solution for zinc displacement for 30 sec, followed by electroless Ni—Cu—P deposition immediately. To immerse the cleaned chip into a mixed solution which is composed of 10 g stearic acid, 10 g glutamic acid and 50 ml ethanol for 5 sec. The process is followed by the thermal treatment and then dip soldering with a 12 to 19 mm/sec speed into a melting solder bath.

We claim:

1. A process for fabricating a solder bump comprising cleaning a substrate comprising an aluminum pad on a silicon chip with an alkali or an acid solution;

immersing said cleaned substrate in a zinc displacement solution and forming a zinc layer on said substrate, said zinc displacement solution comprising NaOH, zinc oxide, potassium sodium tartrate, and sodium nitrate;

exposing said substrate having a zinc layer thereon to an electroless deposition solution comprising $NaH_2PO_2$, nickel ions, and copper ions and forming a Ni—Cu—P layer on said zinc layer of said substrate to form a layered substrate;

dipping said layered substrate into a flux comprising stearic acid and glutamic acid; and then dipping said layered substrate into a molten solder bath comprising a solder alloy.

2. The process according to claim 1 wherein said stearic acid is present in an amount of 0.1–20 g/ml; and said glutamic acid is present in an amount of 0.1–20 g/ml.

3. The process according to claim 1 wherein the electroless solution comprises 25–35 g/L $NiSO_4 \cdot 7H_2O$, 10–20 g/L $NaH_2PO_2 \cdot H_2O$, 35–45 g/L $NH_4Cl$, 1.0–2.0 g/L $CuSO_4 \cdot 5H_2O$, and 45–55 g/L $Na_3C_6H_5O_7 \cdot 2H_2O$ (sodium citrate).

4. A process according to claim 1 wherein said layered substrate is dipped vertically into said molten solder bath.

5. The process according to claim 1 wherein said layered substrate is dipped into said molten solder bath at a speed of 12–19 mm/sec.

6. The process according to claim 1 wherein said molten solder bath has a temperature which is 40°–80° C. higher than the melting point of said solder alloy.

7. The process according to claim 3 wherein said Ni—Cu—P deposit comprises 74 weight % copper.

8. The process according to claim 3 wherein said electroless deposition solution has a pH of 8.5–9.5.

9. The process according to claim 1 wherein said flux contains an alcohol having less than ten carbon atoms.

10. A process for making a substrate having a Ni—Cu—P deposit thereon comprising degreasing an aluminum pad with a 5% by mass NaOH solution for 30 seconds;

deoxidizing said pad for 30 seconds in a 40% by volume nitric acid solution;

immersing said pad for 30 seconds in a zincate solution comprising 120 g/L NaOH, 20 g/L ZnO, 1 g/L $NaNo_3$, and 50 g/L $C_4H_4KNO_6 \cdot 4H_2O$ and forming a zinc layer on said pad;

exposing said pad to an electroless deposition solution comprising 40 g/L $NH_4Cl$, 15 g/L $NaH_2PO_2 \cdot H_2O$, 30 g/L $NiSO_4 \cdot 7H_2O$, 1.5 g/L $CuSO_4 \cdot 5H_2O$ and 50 g/L $Na_3C_6H_5O_7 \cdot 2H_2O$ (sodium citrate), and forming a Ni—Cu—P layer on said zinc layer of said pad;

wherein said Ni—Cu—P deposit comprises 74 weight % copper and 3 weight percent phosphorous;

said Ni—Cu—P deposit having a thickness of about 2μm.

11. A process for making a substrate having a Ni—Cu—P deposit thereon comprising cleaning an aluminum pad with a 10% KOH solution;

deoxidizing said pad in a 60% by volume nitric acid solution;

immersing said pad for 30 seconds in a zincate solution comprising 120 g/L NaOH, 20 g/L ZnO, 1 g/L $NaNo_3$, and 50 g/L $C_4H_4KNO_6 \cdot 4H_2O$ and forming a zinc layer on said pad, exposing said pad to an electroless deposition solution comprising 40 g/L $NH_4Cl$, 15 g/L $NaH_2PO_2 \cdot H_2O$, 30 g/L $NiSO_4 \cdot 7H_2O$, 1.5 g/L $CuSO_4 \cdot 5H_2O$ and 50 g/L $Na_3C_6H_5O_7 \cdot 2H_2O$ (sodium citrate), and forming a Ni—Cu—P deposit on said zinc layer of said pad to form a layered pad;

wherein said Ni—Cu—P deposit comprises 74 weight percent copper and 3 weight percent phosphorous;

said Ni—Cu—P deposit having a thickness of about 2μm;

immersing said layered pad for 5 seconds in a solution comprising 10 g stearic acid, 10 g glutamic acid; and 50 ml ethanol;

heating said layered pad; and dipping said layered pad into a molten solder bath at a speed of 12–19 mm/sec.

12. A process for fabricating a solder bump comprising cleaning a substrate comprising an aluminum pad on a silicon chip with an alkali or an acid solution;

immersing said cleaned substrate in a zinc displacement solution and forming a zinc layer on said substrate, said zinc displacement solution comprising NaOH, zinc oxide, potassium sodium tartrate, and sodium nitrate;

exposing said substrate having a zinc layer thereon to an electroless deposition solution comprising $NaH_2PO_2$, nickel ions, and copper ions and forming a Ni—Cu—P layer on said zinc layer of said substrate;

wherein said electroless solution comprises 25–35 g/L $NiSO_4 \cdot 7H_2O$, 10–20 g/L $NaH_2PO_2 \cdot H_2O$, 35–45 g/L $NH_4Cl$, 1.0–2.0 g/L $CuSO_4 \cdot 5H_2O$, and 45–55 g/L $Na_3C_6H_5O_7 \cdot 2H_2O$ (sodium citrate);

wherein said electroless deposition solution has a pH of 8.5–9.5;

wherein said Ni—Cu—P deposit comprises 74 weight percent copper;

dipping said layered substrate into a flux comprising stearic acid and glutamic acid;

wherein said stearic acid is present in an amount of 0.1–20 g/ml;

said glutamic acid is present in an amount of 0.1–20 g/ml;

wherein said flux contains an alcohol having less than ten carbon atoms;

vertically dipping said layered substrate into a molten solder bath comprising a solder alloy;

said molten solder bath having a temperature which is 40°–80° C. higher than the melting point of said solder alloy;

wherein said layered substrate is dipped into said molten solder bath at a speed of 12–19 mm/sec.

* * * * *